US011574608B2

(12) United States Patent
Kim et al.

(10) Patent No.: US 11,574,608 B2
(45) Date of Patent: Feb. 7, 2023

(54) SOURCE DRIVER CONTROLLING DATA CHARGING TIMES OF HORIZONTAL LINES OF A DISPLAY PANEL, DISPLAY APPARATUS INCLUDING THE SAME, AND OPERATING METHOD OF THE SOURCE DRIVER

(71) Applicant: SAMSUNG ELECTRONICS CO., LTD., Suwon-si (KR)

(72) Inventors: Beophee Kim, Seoul (KR); Sungjin Lim, Suwon-si (KR); Yongjoo Song, Hwaseong-si (KR); Chulho Choi, Seoul (KR); Hanchiang Su, Zhubei (TW); Yichien Wen, Zhubei (TW)

(73) Assignee: Samsung Electronics Co., Ltd., Suwon-si (KR)

( * ) Notice: Subject to any disclaimer, the term of this patent is extended or adjusted under 35 U.S.C. 154(b) by 0 days.

(21) Appl. No.: 17/361,755

(22) Filed: Jun. 29, 2021

(65) Prior Publication Data

US 2022/0084478 A1 Mar. 17, 2022

(30) Foreign Application Priority Data

Sep. 17, 2020 (KR) ..... 10-2020-0120038

(51) Int. Cl.
*G09G 3/36* (2006.01)

(52) U.S. Cl.
CPC ..... *G09G 3/3614* (2013.01); *G09G 3/3688* (2013.01); *G09G 2310/0272* (2013.01); *G09G 2310/08* (2013.01)

(58) Field of Classification Search
CPC ..... G09G 3/36; G09G 3/3611; G09G 3/3614; G09G 3/3622; G09G 3/3625;
(Continued)

(56) References Cited

U.S. PATENT DOCUMENTS 7,683,872 B2 * 3/2010 Jan ..... G09G 3/3648 345/96
8,674,976 B2 3/2014 Kim et al.
(Continued)

FOREIGN PATENT DOCUMENTS

JP 2011-059501 A 3/2011
KR 10-2012-0022470 A 3/2012
(Continued)

*Primary Examiner* — Alexander Eisen
*Assistant Examiner* — Nelson Lam
(74) *Attorney, Agent, or Firm* — Lee IP Law, P.C.

(57) ABSTRACT

A display apparatus includes a display panel including a plurality of horizontal lines each including a plurality of pixels, a timing controller configured to output a polarity control signal representing a polarity corresponding to each of the plurality of horizontal lines and having a value inverted by n horizontal line units, and a source driver configured to generate a timing pulse signal sequentially representing a data charging time of each of the plurality of horizontal lines and to output a data voltage, having a polarity corresponding to each of the plurality of horizontal lines, to the display panel on the basis of the timing pulse signal. When a value of the polarity control signal is inverted, the source driver generates the timing pulse signal including a data charging time corresponding to a count value obtained by counting a number of horizontal lines after a polarity is inverted.

20 Claims, 14 Drawing Sheets

(58) Field of Classification Search
CPC .. G09G 3/3685; G09G 3/3688; G09G 3/3692; G09G 3/3696; G09G 2310/08
USPC ..... 345/87–104
See application file for complete search history.

(56) References Cited

U.S. PATENT DOCUMENTS

| | | | | |
|---|---|---|---|---|
| 9,311,875 | B2 | 4/2016 | Choi et al. | |
| 2006/0290644 | A1* | 12/2006 | Kim | G09G 3/3677 345/100 |
| 2007/0229433 | A1* | 10/2007 | Jang | G09G 3/3677 345/96 |
| 2007/0262941 | A1* | 11/2007 | Jan | G09G 3/3648 345/96 |
| 2008/0001889 | A1* | 1/2008 | Chun | G09G 3/2011 345/96 |
| 2009/0174642 | A1* | 7/2009 | Min | G09G 3/3614 345/92 |
| 2010/0156947 | A1* | 6/2010 | Moon | G09G 3/3648 345/88 |
| 2011/0216052 | A1 | 9/2011 | Tanaka | |
| 2012/0169788 | A1* | 7/2012 | Jang | G09G 3/3614 345/87 |
| 2015/0221273 | A1* | 8/2015 | Lee | G09G 3/3614 345/698 |
| 2020/0035175 | A1 | 1/2020 | Choi et al. | |

FOREIGN PATENT DOCUMENTS

| | | | |
|---|---|---|---|
| KR | 10-1329410 | B1 | 11/2013 |
| KR | 10-1818247 | B1 | 1/2018 |
| KR | 10-1902561 | B1 | 11/2018 |

* cited by examiner

FIG. 5

1200

| | DL1 | DL2 | DL3 | DL4 | DL5 | DL6 | DL7 | DL8 |
|---|---|---|---|---|---|---|---|---|
| GL1 | + | − | + | − | + | − | + | − |
| GL2 | + | − | + | − | + | − | + | − |
| GL3 | + | − | + | − | + | − | + | − |
| GL4 | + | − | + | − | + | − | + | − |
| GL5 | − | + | − | + | − | + | − | + |
| GL6 | − | + | − | + | − | + | − | + |
| GL7 | − | + | − | + | − | + | − | + |
| GL8 | − | + | − | + | − | + | − | + |

FIG. 9

DTT

| INDEX | | | DELAY TIME[μs] |
|---|---|---|---|
| 1 | 2 | 3 | |
| L | L | L | 0.0 |
| L | L | H | 0.4 |
| L | H | L | 0.8 |
| L | H | H | 1.2 |
| H | L | L | 1.6 |
| H | L | H | 2.0 |
| H | H | L | 2.4 |
| H | H | H | 2.8 |

SOURCE DRIVER CONTROLLING DATA CHARGING TIMES OF HORIZONTAL LINES OF A DISPLAY PANEL, DISPLAY APPARATUS INCLUDING THE SAME, AND OPERATING METHOD OF THE SOURCE DRIVER

CROSS-REFERENCE TO RELATED APPLICATION

Korean Patent Application No. 10-2020-0120038, filed on Sep. 17, 2020, in the Korean Intellectual Property Office, and entitled: "Source Driver, Display Apparatus Including the Same, and Operating Method of the Source Driver," is incorporated by reference herein in its entirety.

BACKGROUND

1. Field

Embodiments relate to a source driver, a display apparatus including the same, and an operating method of the source driver.

2. Description of the Related Art

Display apparatuses are being widely applied to smartphones, notebook computers, monitors, etc., and include a display panel for displaying an image, and a plurality of pixels are provided in the display panel. Pixels are driven by a data signal provided from a display driver integrated circuit (IC), and thus, an image is implemented by a display panel.

SUMMARY

Embodiments are directed to a display apparatus, including: a display panel including a plurality of horizontal lines each including a plurality of pixels; a source driver configured to generate a timing pulse signal sequentially representing a data charging time of each of the plurality of horizontal lines, and configured to output a data voltage, having a polarity corresponding to each of the plurality of horizontal lines, to the display panel based on the timing pulse signal; and a timing controller configured to output a polarity control signal representing the polarity of the data voltage corresponding to each of the plurality of horizontal lines, the polarity control signal having a value that is inverted according to n (where n is a positive integer) horizontal line units. When the value of the polarity control signal is inverted, the source driver may generate the timing pulse signal representing the data charging time corresponding to a count value obtained by counting a number of horizontal lines after the polarity of the data voltage is inverted.

Embodiments are also directed to a driving method of a source driver, the driving method including: receiving a polarity control signal representing a polarity corresponding to each of a plurality of horizontal lines of a display panel, the polarity control signal having a value inverted by n (where n is a positive integer) horizontal line units; generating a first timing pulse signal including pulses having a certain pulse width at a period corresponding to one horizontal line time; generating a second timing pulse signal by varying a rising edge time relative to each of the pulses in the first timing pulse signal, based on the polarity control signal; and outputting a data voltage, having a polarity corresponding to each of the plurality of horizontal lines based on the second timing pulse signal, to the display panel.

Embodiments are also directed to a source driver, including: a control logic configured to receive a polarity control signal representing a polarity corresponding to each of a plurality of horizontal lines of a display panel and having a value inverted by n (where n is a positive integer) horizontal line units, and configured to generate a timing pulse signal sequentially representing a data charging time of each of the plurality of horizontal lines; and a buffer configured to output a data voltage to the display panel on the basis of the timing pulse signal. The control logic may be configured to, when a value of the polarity control signal is inverted, generate the timing pulse signal including a data charging time corresponding to a count value obtained by counting a number of horizontal lines after a polarity is inverted.

BRIEF DESCRIPTION OF THE DRAWINGS

Features will become apparent to those of skill in the art by describing in detail example embodiments with reference to the attached drawings in which:

FIG. 5 is a diagram illustrating an example embodiment where a display panel is driven based on a line inversion scheme;

FIG. 9 is a diagram showing a delay time table according to an example embodiment;

DETAILED DESCRIPTION

Figure 1:
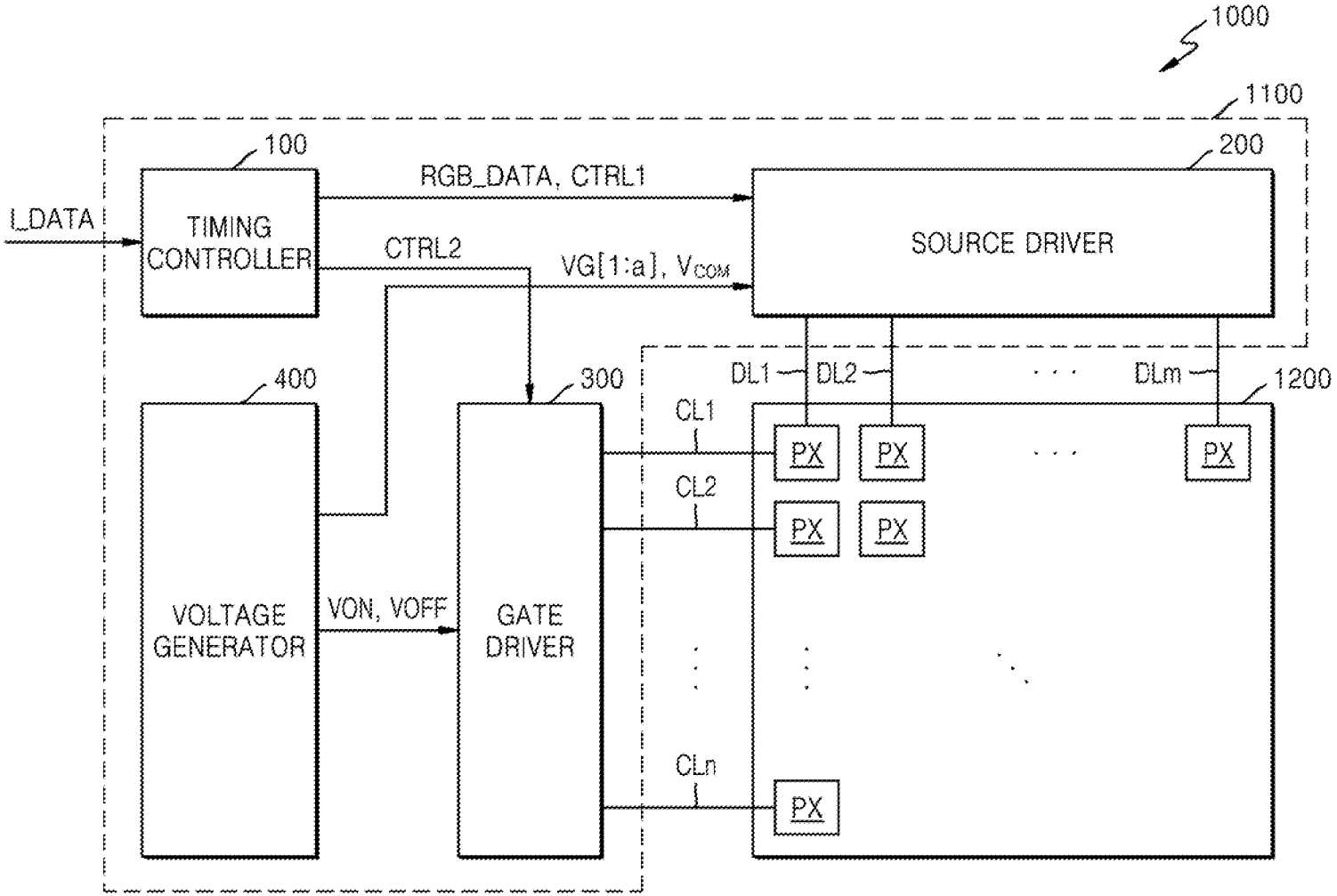
FIG. 1 is a block diagram illustrating a display apparatus according to an example embodiment.

FIG. 1 is a block diagram illustrating a display apparatus 1000 according to an example embodiment.

Referring to FIG. 1, the display apparatus 1000 may include a display panel 1200 which displays an image and a display driving circuit 1100. The display apparatus 1000 according to an example embodiment may be equipped in an electronic device having an image display function. For example, the electronic device may include smartphones, tablet personal computers (PCs), portable multimedia players (PMPs), cameras, wearable devices, televisions (TVs), digital video disk (DVD) players, refrigerators, air conditioners, air cleaners, set-top boxes, robots, drones, various medical apparatuses, navigation devices, global positioning system (GPS) receivers, devices for vehicles, furniture, or various measurement devices.

The display panel 1200 may include a display unit that displays a real image and may include a display apparatus that receives an image signal electrically transferred thereto to display a two-dimensional (2D) image, such as an organic light emitting diode (OLED) display, a thin film transistor-liquid crystal display (TFT-LCD), a field emission display, and a plasma display panel (PDP) display. However, embodiments are not limited thereto, and the display panel 1200 may be implemented as a different kind of flat panel display or flexible display panel.

The display panel 1200 may include a plurality of gate lines GL1 to GLn (where n is an integer of 2 or more), a plurality of data lines DL1 to DLm (where m is an integer of 2 or more) arranged in a direction intersecting with the plurality of gate lines GL1 to GLn, and a plurality of pixels PX respectively provided in a plurality of areas defined by intersections of the gate lines GL1 to GLn and the data lines DL1 to DLm.

For example, when the display panel 1200 is a TFT-LCD, each of the pixels PX may include a thin film transistor (TFT) including a gate electrode and a source electrode respectively connected to a gate line and a data line corresponding thereto, a liquid crystal capacitor connected to a drain electrode of the TFT, and a storage capacitor. Also, when a gate line is selected from among the plurality of gate lines GL1 to GLn, TFTs of pixels PX connected to the selected gate line may be turned on, and then a source driver 200 may apply data voltages to the plurality of data lines DL1 to DLm. A data voltage may be applied to the liquid crystal capacitor and the storage capacitor via a TFT of a corresponding pixel PX, and the liquid crystal capacitor and the storage capacitor may be driven by the data voltage, whereby an image may be displayed.

The display panel 1200 may include a plurality of horizontal lines (or rows), and one horizontal line may be configured with pixels PX connected to one gate line corresponding thereto. For example, pixels PX of a first row connected to a first gate line GL1 may configure a first horizontal line, and pixels PX of a second row connected to a second gate line GL2 may configure a second horizontal line.

Pixels PX of one horizontal line may be driven for a horizontal line time, and for a next horizontal line time, pixels PX of another horizontal line may be driven. For example, for a first horizontal line time, pixels PX of a first horizontal line corresponding to the first gate line GL1 may be driven, and then for a second horizontal line time, pixels PX of a second horizontal line corresponding to a second gate line GL2 may be driven. In this manner, for first to $n^{th}$ horizontal line times, the pixels PX of the display panel 1200 may be driven.

The display driving circuit 1100 may include a timing controller 100, the source driver 200, a gate driver 300, and a voltage generator 400. The display driving circuit 1100 may convert image data I_DATA, received from the outside, into a plurality of analog signals (for example, a plurality of data voltages) for driving the display panel 1200, and may supply the plurality of analog signals to the display panel 1200.

The timing controller 100 may control all operations of the display driving circuit 1100. For example, the timing controller 100 may control elements (for example, the source driver 200 and the gate driver 300) of the display driving circuit 1100 so that the display panel 1200 displays an image corresponding to the image data I_DATA received from the outside.

In detail, the timing controller 100 may generate pixel data RGB_DATA, having a format converted based on an interface specification matching the source driver 200, on the basis of the received image data I_DATA, and may output the pixel data RGB_DATA to the source driver 200. Also, the timing controller 100 may generate various control signals CTRL1 and CTRL2 for controlling timings of the source driver 200 and the gate driver 300. The timing controller 100 may output a first control signal CTRL1 to the source driver 200, and may output a second control signal CTRL2 to the gate driver 300. The first control signal CTRL1 may include a polarity control signal, and the second control signal CTRL2 may include a gate timing signal.

The source driver 200 may convert the pixel data RGB_DATA, received from the timing controller 100, into a plurality of image signals (for example, a plurality of data voltages), and may output the plurality of data voltages to the display panel 1200 through the plurality of data lines DL1 to DLm.

In detail, the source driver 200 may receive the pixel data RGB_DATA by horizontal line units (i.e., by data units corresponding to a plurality of pixels PX included in one horizontal line of the display panel 1200). Also, the source driver 200 may convert the pixel data RGB_DATA, received from the timing controller 100, into a plurality of data voltages on the basis of a plurality of grayscale voltages VG[1:a] (also referred to as a gamma voltage) received from the voltage generator 400. Also, the source driver 200 may output the plurality of data voltages to the display panel 1200 by horizontal line units through the plurality of data lines DL1 to DLm. For example, the source driver 200 may output a plurality of data voltages corresponding to a plurality of pixels PX included in a first horizontal line of the display panel 1200, and then may output a plurality of data voltages corresponding to a plurality of pixels PX included in a second horizontal line.

The gate driver 300 may be connected to the plurality of gate lines GL1 to GLn of the display panel 1200, and may sequentially drive the plurality of gate lines GL1 to GLn of the display panel 1200. The gate driver 300 may sequentially provide a plurality of gate-on signals having an active level (for example, a logic high level) to the plurality of gate lines GL1 to GLn on the basis of control by the timing controller 100. Therefore, the plurality of gate lines GL1 to GLn may be sequentially selected, and a plurality of data voltages may be applied to pixels PX of a horizontal line corresponding to a selected gate line through the plurality of data lines DL1 to DLm.

The voltage generator 400 may generate various voltages used for driving of the display apparatus 1000. For example, the voltage generator 400 may receive a source voltage from the outside. Also, the voltage generator 400 may generate the plurality of grayscale voltages VG[1:a] and a common voltage VCOM, and may output the plurality of grayscale voltages VG[1:a] and the common voltage VCOM to the source driver 200. Also, the voltage generator 400 may generate a gate-on voltage VON and a gate-off voltage VOFF, and may output the gate-on voltage VON and the gate-off voltage VOFF to the gate driver 300.

A configuration of the display driving circuit 1100 according to an example embodiment may include an additional element. For example, the display driving circuit 110 may be implemented to include a memory (not shown) that stores the received image data I_DATA by frame units.

Figure 2:
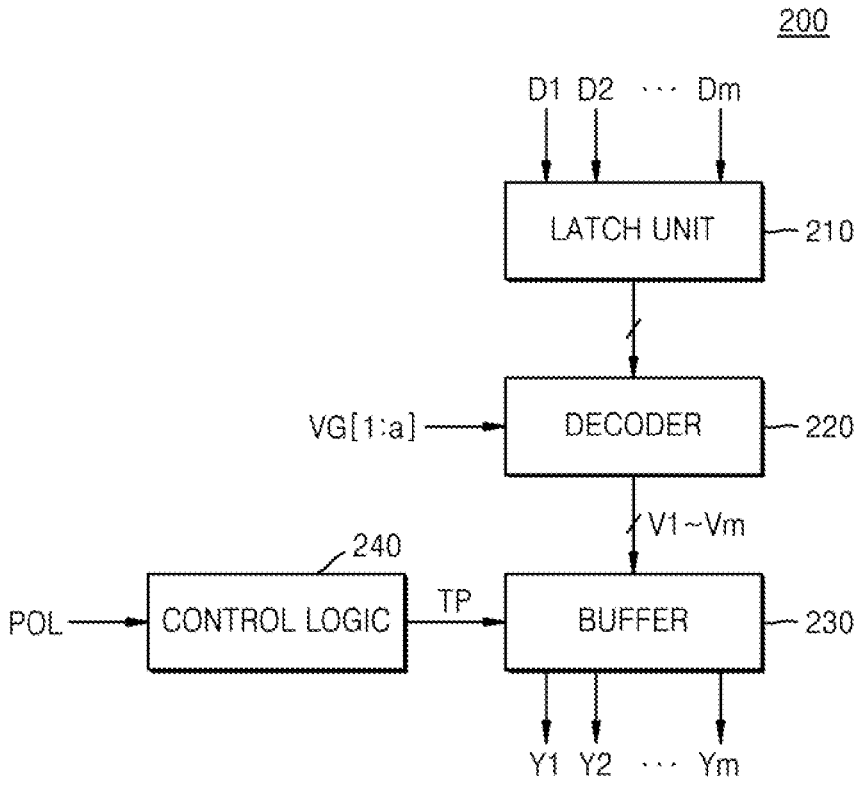
FIG. 2 is a block diagram illustrating a configuration of a source driver according to an example embodiment.

FIG. 2 is a block diagram illustrating a configuration of a source driver 200 according to an example embodiment. In detail, FIG. 2 is a block diagram illustrating a configuration of the source driver 200 of FIG. 1.

Referring to FIGS. 1 and 2, the source driver 200 may include a control logic 240, a latch unit 210, a decoder 220, and a buffer 230. The source driver 200 may be implemented as one semiconductor chip. Alternatively, a function of the source driver 200 may be implemented in a semiconductor device such as a system-on-chip.

The source driver 200 may include m number of channels on the basis of m number of data lines DL1 to DLm, and may output, through the m number of channels, data voltages Y1 to Ym for driving the display panel 1200. The data voltages Y1 to Ym may be signals provided for driving pixels PX, connected to one gate line, of the display panel 1200, and the data voltages Y1 to Ym may be output to m number of gate lines GL1 to GLm, whereby one frame may be implemented in the display panel 1200.

The latch unit 210 may receive and latch pieces of pixel data D1 to Dm for driving the display panel 1200. The pixel data D1 to Dm may be pixel data RGB_DATA provided from the timing controller 100 of FIG. 1. The latch unit 210 may receive and store the pieces of pixel data D1 to Dm, and may output the stored pixel data D1 to Dm to the decoder 220 in parallel.

The decoder 220 may decode the pixel data D1 to Dm, which correspond to digital signals, into analog voltages. The decoder 220 may include a plurality of decoders (not shown) corresponding to the number of channels of the source driver 200, and corresponding pixel data and a plurality of grayscale voltages VG[1:a] may be respectively provided to the plurality of decoders. The plurality of grayscale voltages VG[1:a] may be received from the voltage generator 400. The decoder 220 may decode the pixel data D1 to Dm, and may select and output one grayscale voltage from among the plurality of grayscale voltages VG[1:a].

For example, when each of the pixel data D1 to Dm consists of k bits (where k is an integer of 1 or more) and the plurality of grayscale voltages VG[1:a] include 2 k number of grayscale voltages, each decoder may decode k-bit data to select and output one grayscale voltage.

Voltages generated by the voltage generator 400 may be referred to as reference grayscale voltages VG[1:a], and voltages that are selected by the decoder 220 on the basis of each of the m channels may be referred to as grayscale voltages V1 to Vm.

The grayscale voltages V1 to Vm output from the decoder 220 may be provided as the data voltages Y1 to Ym to the data lines DL1 to DLm via the buffer 230. The buffer 230 may receive and buffer the grayscale voltages V1 to Vm to generate the data voltages Y1 to Ym for driving the data lines DL1 to DLm. The buffer 230 may include m number of output buffers on the basis of the m channels.

The control logic 240 may provide the buffer 230 with a timing pulse TP representing an output timing of the buffer 230 on the basis of control by the timing controller 100. The buffer 230 may output the data voltages Y1 to Ym by horizontal line units on the basis of a timing pulse signal TP.

The timing pulse signal TP may include a plurality of pulses representing an output timing of a data voltage corresponding to each of the plurality of horizontal lines of the display panel 1200. The output timing may be a time at which a pulse is shifted from a first level (for example, a logic high level) to a second level (for example, a logic low level), or may be a time at which the pulse is shifted from the second level to the first level. The timing pulse signal TP may be implemented to include one pulse by one horizontal line time units, but embodiments are not limited thereto.

In a case where the display panel 1200 is a liquid crystal display panel, when a data voltage having the same polarity is continuously applied to the display panel 1200, a liquid crystal may be degraded. Therefore, a polarity inversion scheme of changing a polarity of a data voltage at a certain period may be applied to the display apparatus 1000, so as to prevent quality from being degraded. The polarity inversion scheme may include changing a polarity of a data voltage on the basis of a period corresponding to one or more scan units. The polarity inversion scheme may include a frame inversion scheme, a line inversion scheme, a column inversion scheme, a dot inversion scheme, and a hybrid inversion scheme on the basis of a scan unit.

An example embodiment will now be described where the line inversion scheme of changing a polarity on the basis at least one horizontal line unit is applied.

In an example embodiment, the source driver 200 may operate based on the line inversion scheme according to a polarity control signal POL of a first control signal CTRL1 received from the timing controller 100. The polarity control signal POL may be a signal having a value (or state) that is inverted by (or per) n horizontal line units, e.g., inverted from a high level to a low level, or inverted from a low level to a high level. The source driver 200 may change a polarity of a data voltage by (or per) n horizontal line units on the basis of the polarity control signal POL, and may provide a polarity-inverted data voltage to the display panel 1200.

In a case where driving is performed based on the polarity inversion scheme, a charge sharing operation of temporarily sharing electric charges of the data lines DL1 to DLm may be additionally performed whenever a polarity is changed. For example, when data voltages of horizontal lines corresponding to a positive polarity are output and then a polarity is changed to a negative polarity, or data voltages of horizontal lines corresponding to a negative polarity are output and then a polarity is changed to a positive polarity, the charge sharing operation may be performed. For example, the charge sharing operation may be performed for a horizontal line time corresponding to a first horizontal line after a polarity is changed.

The charge sharing operation may include connecting and charging the data lines DL1 to DLm with a common voltage VCOM (i.e., a charge sharing voltage), and then disconnecting the data lines DL1 to DLm; outputting of each of the data voltages Y1 to Ym may be stopped while the charge sharing operation is being performed. Therefore, in a case where the source driver 200 is implemented to perform an output of a data voltage on one horizontal line by horizontal line time units, all of the charge sharing operation and a data output operation may be performed on a first horizontal line for a horizontal line time after a polarity is changed.

Therefore, in a horizontal line on which the charge sharing operation is performed, the data voltages Y1 to Ym may be output to a corresponding horizontal line for only a time, other than a time (i.e., a charge sharing time) for which the charge sharing operation is performed, of a horizontal line time. Thus, a time for which the data voltages Y1 to Ym are output may be reduced, and thus, a pixel PX of a corresponding horizontal line may not be sufficiently charged. In order to provide for sufficient charging, the source driver 200 according to an example embodiment may generate the timing pulse signal TP where a data charging time of each horizontal line is sufficiently secured, based on the polarity control signal POL. This will now be described below in detail with reference to FIGS. 3 to 6.

Figure 3:
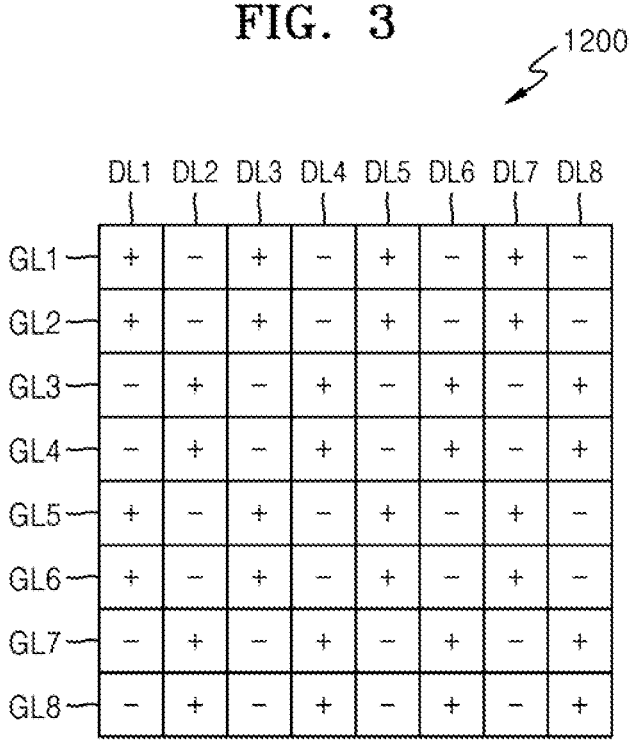
FIG. 3 is a diagram illustrating an example embodiment where a display panel is driven based on a line inversion scheme.
Figure 4:
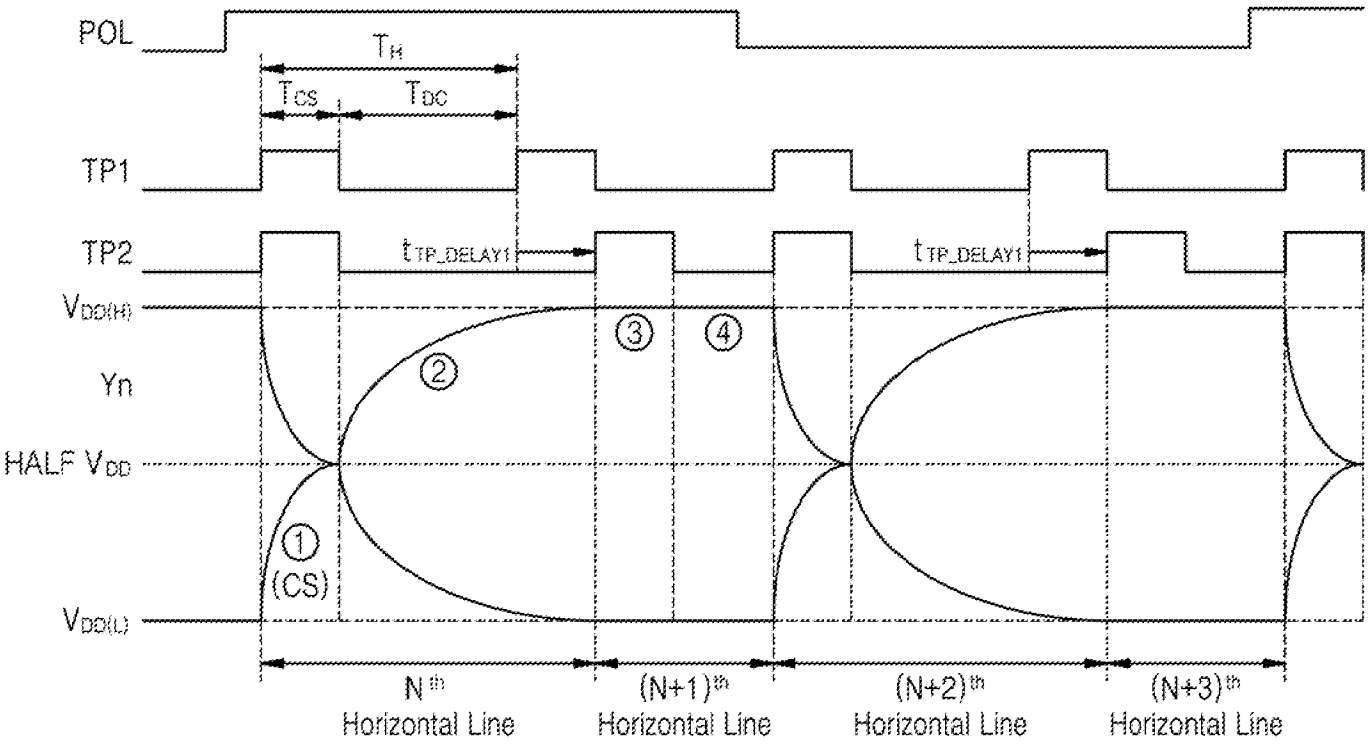
FIG. 4 is a diagram showing waveforms of various signals based on the line inversion scheme of FIG. 3.

FIG. 3 is a diagram illustrating an example embodiment where the display panel 1200 is driven based on a line inversion scheme, and FIG. 4 is a diagram showing waveforms of various signals based on the line inversion scheme of FIG. 3.

FIG. 3 is a diagram illustrating an example embodiment where the display panel 1200 is driven based on a 2-line inversion scheme of inverting a polarity of a data voltage by two horizontal line units. In FIG. 3, for convenience of description, an example will now be described where the display panel 1200 includes eight data lines DL1 to DL8, eight gate lines GL1 to GL8, and sixty-four pixels.

Referring to FIG. 3, pixels disposed in one vertical line may be driven by alternately using a positive data voltage and a negative data voltage at every two horizontal lines. For example, in order to drive pixels corresponding to odd-numbered data lines DL1, DL3, DL5, and DL7, positive data voltages may be provided to pixels connected to a first gate line GL1, a second gate line GL2, a fifth gate line GL5, and a sixth gate line GL6, and negative data voltages may be provided to pixels connected to a third gate line GL3, a fourth gate line GL4, a seventh gate line GL7, and an eighth gate line GL8. Also, in order to drive pixels corresponding to even-numbered data lines DL2, DL4, DL6, and DL8, negative data voltages may be provided to the pixels connected to the first gate line GL1, the second gate line GL2, the fifth gate line GL5, and the sixth gate line GL6, and positive data voltages may be provided to the pixels connected to the third gate line GL3, the fourth gate line GL4, the seventh gate line GL7, and the eighth gate line GL8.

In FIG. 3, it is illustrated that pixels PX disposed in one horizontal line may be driven by alternately using a positive data voltage and a negative data voltage at every two horizontal lines, but embodiments are not limited thereto and pixels PX disposed in one horizontal line may be driven with data voltages having the same polarity.

FIG. 4 shows waveforms of various signals in association with an example embodiment where a data voltage Yn of an $n^{th}$ channel of the source driver 200 is provided to the display panel 1200 on the basis of the line inversion scheme of FIG. 3. Hereinafter, for convenience of description, an example will now be described where the same pieces of pixel data are applied to the source driver 200.

Referring to FIG. 4, the source driver 200 (in detail, the control logic 240) may generate a first timing pulse signal TP1, which periodically has pulses having a certain pulse width. For example, the first timing pulse signal TP1 may repeatedly include a pulse by horizontal line time $T_H$ units, in which a first level (for example, a logic high level) may represent a charge sharing time $T_{CS}$, and a second level (for example, a logic low level) may represent a data charging time $T_{DC}$. For the charge sharing time $T_{CS}$, data lines may be charged with a common voltage VCOM. The common voltage VCOM may have a voltage level HALF $V_{DD}$ in the middle between a positive data voltage $V_{DD(H)}$ and a negative data voltage $V_{DD(L)}$, but the common voltage VCOM may have a different level according to embodiments.

In a case where the display panel 1200 is driven based on the line inversion scheme by using the first timing pulse signal TP1, a first horizontal line (an $N^{th}$ horizontal line and an $N+2^{th}$ horizontal line of FIG. 4) after a polarity is changed may be charged with the data voltage Yn for only the data charging time $T_{DC}$ reduced by the charge sharing operation, and thus, may not reach a target voltage (for example, $V_{DD(L)}$ or $V_{DD(H)}$). Therefore, the source driver 200 may generate a second timing pulse TP2 where a data charging time is sufficient, based on the first timing pulse signal TP1 and the polarity control signal POL.

In detail, the source driver 200 may receive the polarity control signal POL having a value that is inverted by two horizontal line units. Based on the polarity control signal POL, the source driver 200 may check a first horizontal line (for example, an $N^{th}$ horizontal line and an $N+2^{th}$ horizontal line) after a polarity is changed, and may delay, by a delay time $t_{TP_DELAY1}$, a pulse corresponding to a second horizontal line (for example, an $N+1^{th}$ horizontal line and an $N+3^{th}$ horizontal line) so that the data charging time of the first horizontal line increases in the first timing pulse signal TP1, thereby generating a second timing pulse signal TP2.

The delay time $t_{TP_DELAY1}$ may be a time that is added to a data charging time so that a horizontal line, on which the charge sharing operation has been performed, is sufficiently charged with a target data voltage. In an example embodiment, the delay time $t_{TP_DELAY1}$ may be determined based on a time for which a data voltage is charged from the common voltage VCOM or HALF $V_{DD}$ to the positive data voltage $V_{DD(H)}$ (or the negative data voltage $V_{DD(L)}$). For example, in a case where a time, for which a data voltage is charged from the common voltage VCOM or HALF $V_{DD}$ to the positive data voltage $V_{DD(H)}$ (or the negative data voltage $V_{DD(L)}$), is t1, and a data charging time of a first horizontal line after a polarity is changed in a current first timing pulse signal TP1 is t2, the delay time $t_{TP_DELAY1}$ may be determined to be t1-t2. Information about the delay time $t_{TP_DELAY1}$ may be received from the timing controller 100, or may be stored in a memory of the source driver 200.

The source driver 200 may generate the second timing pulse signal TP2 so as not to change a total time (i.e., $2T_H$) allocated to horizontal lines (for example, the $N^{th}$ to $N+1^{th}$ horizontal lines or the $N+2^{th}$ to $N+3^{th}$ horizontal lines) having the same polarity. Thus, a total time allocated to positive horizontal lines and a total time allocated to negative horizontal lines may be the same in the first timing pulse signal TP1 and the second timing pulse signal TP2.

As described above, because a total time allocated to horizontal lines having the same polarity is the same and a pulse of a second horizontal line after a polarity is changed is delayed, a data charging time of the second horizontal line may be shortened by the delayed time.

The source driver 200 may output the data voltage Yn on the basis of the second timing pulse signal TP2. In detail, referring to FIG. 4, the source driver 200 may perform a charge sharing (CS) operation for a charge sharing time $T_{CS}$ corresponding to a pulse of the $N^{th}$ horizontal line on the basis of the order of the $N^{th}$ horizontal line which is a first horizontal line after a polarity is changed (see ① in FIG. 4).

When the charge sharing operation is completed, the source driver 200 may output the data voltage Yn of the $N^{th}$ horizontal line for a data charging time up to before a pulse of the $N+1^{th}$ horizontal line (see ② in FIG. 4).

The source driver 200 may perform a high impedance (Hi-Z) operation for the time $T_{CS}$ corresponding to a pulse of the $N+1^{th}$ horizontal line (see ③ in FIG. 4). Because a charge sharing operation has been performed on the N horizontal line having the same polarity as that of the $N+1^{th}$ horizontal line, a charge sharing operation may be omitted. The high impedance operation may be an operation where the display panel 1200 maintains a previous charge level by turning off a switch connecting the source driver 200 to the display panel 1200.

When the high impedance operation is completed, the source driver 200 may output the data voltage Yn of the $N+1^{th}$ horizontal line for a data charging time up to before a pulse of the $N+2^{th}$ horizontal line (see ④ in FIG. 4).

According to the above described example embodiment, the source driver 200 may be implemented to perform an output operation on the data voltage Yn instead of the high impedance operation for the time $T_{CS}$ corresponding to a pulse of the $N+1^{th}$ horizontal line. Thus, the source driver 200 may output the data voltage Yn for a horizontal line time of the $N+1^{th}$ horizontal line.

Based on the order of each of the $N+2^{th}$ horizontal line and the $N+3^{th}$ horizontal line after a polarity is changed, an operation of the source driver 200 may be substantially the same as an operation based on the order of each of the $N^{th}$ horizontal line and the $N+1^{th}$ horizontal line, except that a polarity of a data voltage is changed.

Figure 6:
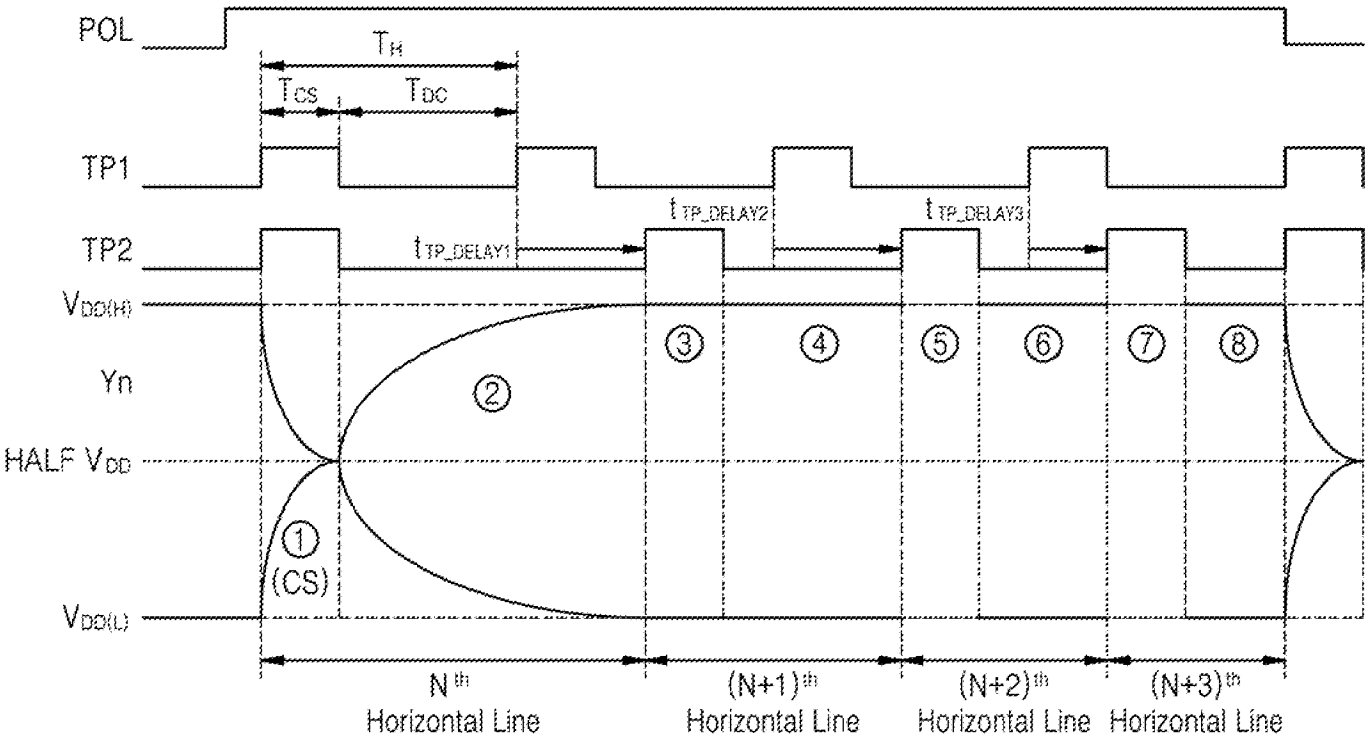
FIG. 6 is a diagram showing waveforms of various signals based on the line inversion scheme of FIG. 5.

FIG. 5 is a diagram illustrating an example embodiment where the display panel 1200 is driven based on a line inversion scheme, and FIG. 6 is a diagram showing waveforms of various signals based on the line inversion scheme of FIG. 5.

FIG. 5 is a diagram illustrating an example embodiment where the display panel 1200 is driven based on a 4-line inversion scheme of inverting a polarity of a data voltage by four horizontal line units. In FIG. 5, for convenience of description, an example will now be described where the display panel 1200 includes eight data lines DL1 to DL8, eight gate lines GL1 to GL8, and sixty-four pixels.

Referring to FIG. 5, pixels disposed in one vertical line may be driven by alternately using a positive data voltage and a negative data voltage at every four horizontal lines. For example, in order to drive pixels corresponding to odd-numbered data lines DL1, DL3, DL5, and DL7, positive data voltages may be provided to pixels connected to a first gate line GL1, a second gate line GL2, a third gate line GL3, and a fourth gate line GL4, and negative data voltages may be provided to pixels connected to a fifth gate line GL5, a sixth gate line GL6, a seventh gate line GL7, and an eighth gate line GL8. Also, in order to drive pixels corresponding to even-numbered data lines DL2, DL4, DL6, and DL8, negative data voltages may be provided to the pixels connected to the first gate line GL1, the second gate line GL2, the third gate line GL3, and the fourth gate line GL4, and positive data voltages may be provided to the pixels connected to the fifth gate line GL5, the sixth gate line GL6, the seventh gate line GL7, and the eighth gate line GL8.

In FIG. 5, it is illustrated that pixels PX disposed in one horizontal line may be driven by alternately using a positive data voltage and a negative data voltage at every four horizontal lines, but embodiments are not limited thereto and pixels PX disposed in one horizontal line may be driven with data voltages having the same polarity.

FIG. 6 shows waveforms of various signals in association with an embodiment where a data voltage Yn of an $n^{th}$ channel of the source driver 200 is provided to the display panel 1200 on the basis of the line inversion scheme of FIG. 5. In FIG. 6, descriptions which are the same as or similar to the descriptions of FIG. 4 may be omitted.

Referring to FIG. 6, the source driver 200 (in detail, the control logic 240) may generate a first timing pulse signal TP1, which periodically has pulses having a certain pulse width. For example, the first timing pulse signal TP1 may repeatedly include a pulse by horizontal line time $T_H$ units, and a first level (for example, a logic high level) may represent a charge sharing time $T_{CS}$, and a second level (for example, a logic low level) may represent a data charging time $T_{DC}$. For the charge sharing time $T_{CS}$, data lines may be charged with a common voltage VCOM and the common voltage VCOM may have a voltage level HALF $V_{DD}$ in the middle between a positive data voltage $V_{DD(H)}$ and a negative data voltage $V_{DD(L)}$.

Also, the source driver 200 may receive a polarity control signal POL having a value that is inverted by four horizontal line units. Based on the polarity control signal POL, the source driver 200 may check a first horizontal line (for example, an $N^{th}$ horizontal line) after a polarity is changed, delay a pulse corresponding to a second horizontal line (for example, an $N+1^{th}$ horizontal line) by a first delay time $t_{TP_DELAY1}$, delay a pulse corresponding to a third horizontal line (for example, an $N+2^{th}$ horizontal line) by a second delay time $t_{TP_DELAY2}$, and delay a pulse corresponding to a fourth horizontal line (for example, an $N+3^{th}$ horizontal line) by a third delay time $t_{TP_DELAY3}$ so that a data charging time of the first horizontal line increases in the first timing pulse signal TP1, thereby generating a second timing pulse signal TP2.

In an example embodiment, as shown in FIG. 6, the first, second, and third delay times $t_{TP_DELAY1}$, $t_{TP_DELAY2}$, and $t_{TP_DELAY3}$ may decrease in the order of the first delay time $t_{TP_DELAY1}$, the second delay time $t_{TP_DELAY2}$, and the third delay time $t_{TP_DELAY3}$. In another example embodiment, the first, second, and third delay times $t_{TP_DELAY1}$, $t_{TP_DELAY2}$, and $t_{TP_DELAY3}$ may increase in the order of the first delay time $t_{TP_DELAY1}$, the second delay time $t_{TP_DELAY2}$, and the third delay time $t_{TP_DELAY3}$. In another example embodiment, at least some of the first, second, and third delay times $t_{TP_DELAY1}$, $t_{TP_DELAY2}$, and $t_{TP_DELAY3}$ may be the same. Information about the first, second, and third delay times $t_{TP_DELAY1}$, $t_{TP_DELAY2}$, and $t_{TP_DELAY3}$ may be received from the timing controller 100, or may be stored in a memory of the source driver 200.

The source driver 200 may generate the second timing pulse signal TP2 so as not to change a total time (i.e., $4T_H$) allocated to horizontal lines (for example, the $N^{th}$ to $N+3^{th}$ horizontal lines) having the same polarity. Thus, a total time allocated to positive horizontal lines and a total time allocated to negative horizontal lines may be the same in the first timing pulse signal TP1 and the second timing pulse signal TP2.

As described above, because a total time allocated to horizontal lines having the same polarity is the same and pulses of second to fourth horizontal lines after a polarity is changed are delayed, a data charging time of the second to fourth horizontal lines may be shortened by the delayed time. However, embodiments are not limited thereto, and the second timing pulse signal TP2 may be generated by delaying only pulses of some of the second to fourth horizontal lines.

The source driver 200 may output the data voltage Yn on the basis of the second timing pulse signal TP2. In detail, referring to FIG. 6, the source driver 200 may perform a charge sharing (CS) operation for a charge sharing time $T_{CS}$ corresponding to a pulse of the $N^{th}$ horizontal line on the basis of the order of the N horizontal line which is a first horizontal line after a polarity is changed (see ① in FIG. 6).

When the charge sharing operation is completed, the source driver 200 may output the data voltage Yn of the $N^{th}$ horizontal line for a data charging time up to before a pulse of the $N+1^{th}$ horizontal line (see ② in FIG. 6).

The source driver 200 may perform a high impedance (Hi-Z) operation for the time $T_{CS}$ corresponding to a pulse of the N+1$^{th}$ horizontal line (see ③ in FIG. 6). Because a charge sharing operation has been performed on the N$^{th}$ horizontal line having the same polarity as that of the N+1$^{th}$ horizontal line, a charge sharing operation may be omitted.

When the high impedance operation is completed, the source driver 200 may output the data voltage Yn of the N+1$^{th}$ horizontal line for a data charging time up to before a pulse of the N+2$^{th}$ horizontal line (see ④ in FIG. 6).

The source driver 200 may perform the high impedance (Hi-Z) operation for the time $T_{CS}$ corresponding to a pulse of the N+2$^{th}$ horizontal line (see ⑤ in FIG. 6).

When the high impedance (Hi-Z) operation is completed, the source driver 200 may output the data voltage Yn of the N+2$^{th}$ horizontal line for a data charging time up to before a pulse of the N+3$^{th}$ horizontal line (see ⑥ in FIG. 6).

The source driver 200 may perform the high impedance (Hi-Z) operation for the time $T_{CS}$ corresponding to a pulse of the N+3$^{th}$ horizontal line (see ⑦ in FIG. 6).

When the high impedance operation is completed, the source driver 200 may output the data voltage Yn of the N+3$^{th}$ horizontal line for a data charging time up to before a pulse of the N+4$^{th}$ horizontal line (see ⑧ in FIG. 6).

According to an example embodiment, the source driver 200 may perform an output operation on the data voltage Yn instead of the high impedance operation for the time $T_{CS}$ corresponding to a pulse of the N+1$^{th}$ horizontal line, a pulse of the N+2$^{th}$ horizontal line, and a pulse of the N+3$^{th}$ horizontal line. Thus, the source driver 200 may output the data voltage Yn for a horizontal line time of each of the N+1$^{th}$ horizontal line, the N+2$^{th}$ horizontal line, the N+3$^{th}$ horizontal line.

As described above with reference to FIGS. 3 to 6, example embodiments may use a timing pulse signal where output timings of some horizontal lines having the same polarity are delayed, in a total time allocated to the horizontal lines having the same polarity. Thus, the source driver 200 according to an example embodiment may sufficiently perform charging of a data voltage of each horizontal line, and may not increase a time for displaying an image signal of one frame on the display panel 1200.

Figure 7:
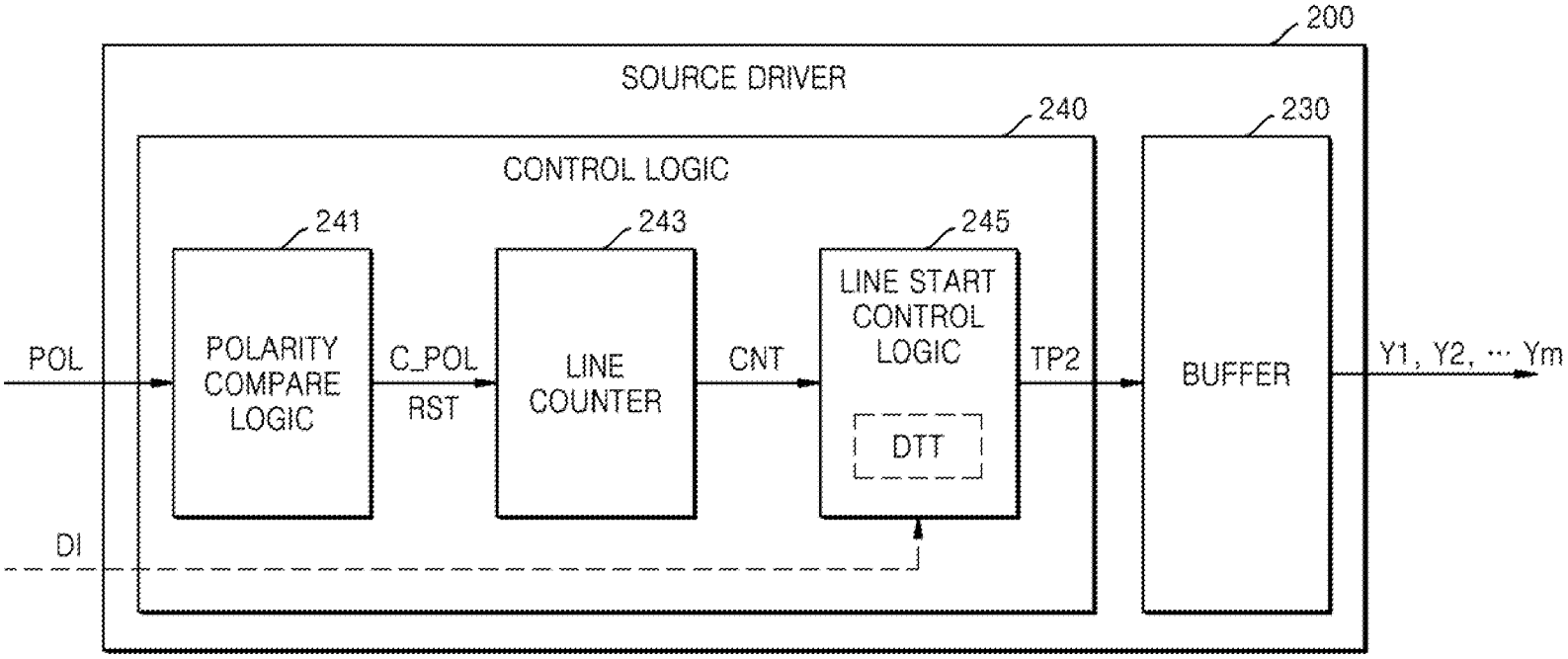
FIG. 7 is a block diagram illustrating a detailed configuration of a source driver according to an example embodiment.
Figure 8:
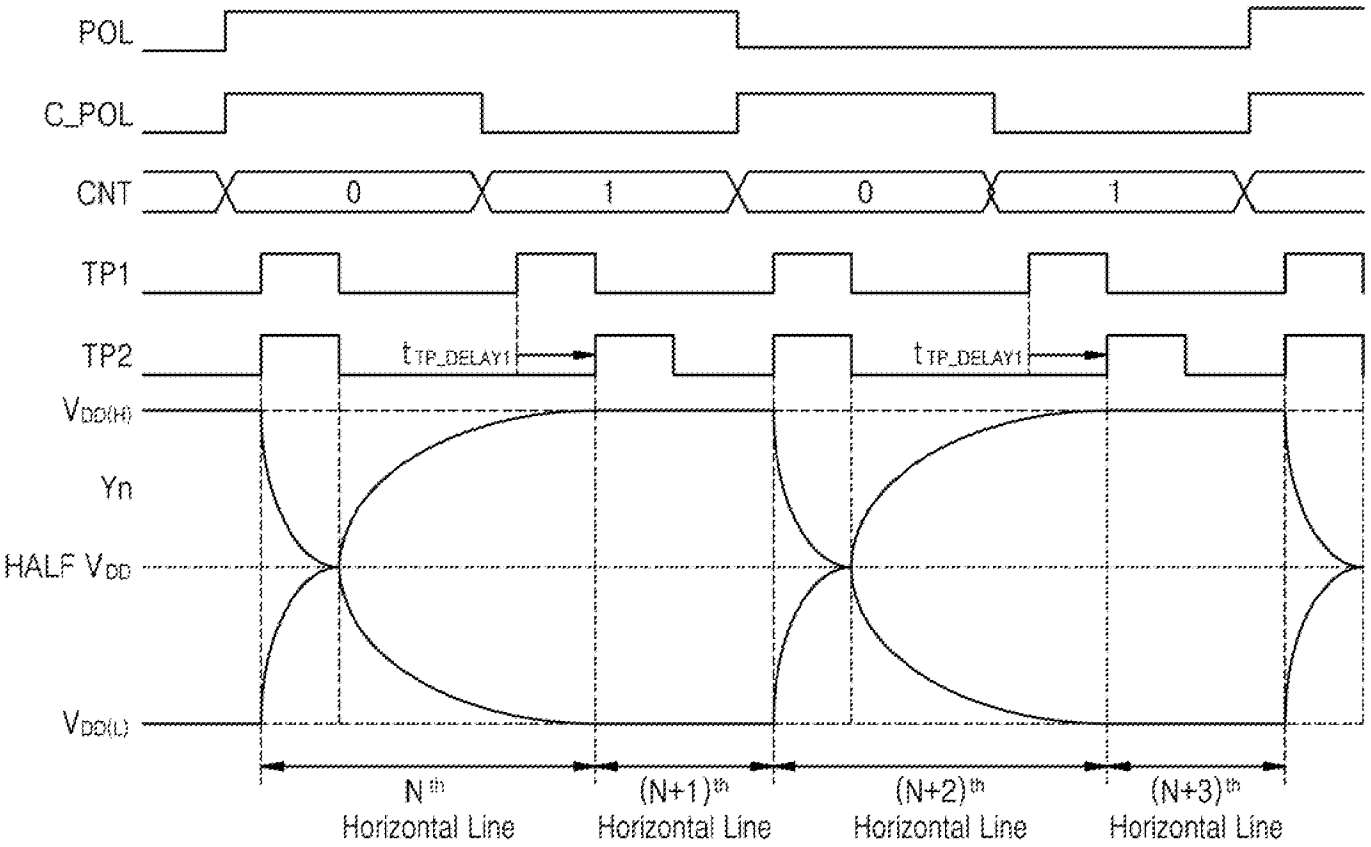
FIG. 8 is a diagram showing waveforms of various signals generated by the source driver of FIG. 7.

FIG. 7 is a block diagram illustrating a detailed configuration of a source driver 200 according to an example embodiment. FIG. 8 is a diagram showing waveforms of various signals generated by the source driver 200 of FIG. 7. FIG. 9 is a diagram showing a delay time table DTT according to an example embodiment. In detail, FIG. 9 is a diagram illustrating an example of the delay time table DTT of FIG. 7.

In the present example embodiment, for convenience of description, an example where the source driver 200 is based on the 2-line inversion scheme will now be described.

Referring to FIG. 7, a control logic 240 may include a polarity compare logic 241, a line counter 243, and a line start control logic 240.

The polarity compare logic 241 may receive a polarity control signal POL from a timing controller 100 and may generate a polarity comparison signal C_POL on the basis of the polarity control signal POL. Also, the polarity compare logic 241 may provide the generated polarity comparison signal C_POL to the line counter 243. The polarity comparison signal C_POL may represent a comparison result obtained by comparing a polarity of a current horizontal line (for example, an N$^{th}$ horizontal line) with a polarity of a previous horizontal line (for example, an N−1$^{th}$ horizontal line). For example, when the polarity of the current horizontal line differs from that of the previous horizontal line, the polarity comparison signal C_POL may have a first level (for example, a logic high level), and when the polarity of the current horizontal line is the same as that of the previous horizontal line, the polarity comparison signal C_POL may have a second level (for example, a logic low level). Therefore, when the polarity comparison signal C_POL is shifted from the second level to the first level, this may indicate that a polarity is changed in a corresponding horizontal line.

The polarity compare logic 241 may generate a reset signal RST on the basis of the polarity comparison signal C_POL, and may provide the generated reset signal RST to the line counter 243. For example, a rising edge of the polarity comparison signal C_POL may be sensed, and thus the polarity compare logic 241 may generate the reset signal RST having an active level. Therefore, the reset signal RST may have the active level in association with a polarity-changed horizontal line. For example, the reset signal RST may have the active level at each time corresponding to two horizontal lines in the 2-line inversion scheme, and may have the active level at each time corresponding to four horizontal lines in the 4-line inversion scheme.

The line counter 243 may count the number of horizontal lines to generate a count signal CNT of FIG. 8. For example, when a rising edge or a falling edge of the polarity comparison signal C_POL is sensed, the line counter 243 may increase a count value of the count signal CNT. The line counter 243 may provide the count signal CNT to the line start control logic 240.

The line counter 243 may reset the count signal CNT on the basis of the reset signal RST received from the polarity compare logic 241. For example, when the reset signal RST has the active level, the line counter 243 may reset the count signal CNT. The reset signal RST may have the active level in association with a polarity-changed horizontal line, and thus, the count signal CNT may be reset at every polarity-changed horizontal line.

The line start control logic 240 may generate a first timing pulse signal TP1. The first timing pulse signal TP1 of FIG. 8 may be the same as the first timing pulse signal TP1 of FIG. 4, and thus, its repeated description is omitted.

The line start control logic 240 may generate a second timing pulse signal TP2 on the basis of the first timing pulse signal TP1 and the count signal CNT. For example, when the count signal CNT has a reset value (0 in FIG. 8), the line start control logic 240 may determine that a corresponding horizontal line is a first horizontal line after a polarity is changed, and may delay (by a delay time $t_{TP_DELAY1}$ in FIG. 8) a horizontal line (i.e., a second horizontal line) that is next to a corresponding horizontal line in the first timing pulse signal TP1, to generate the second timing pulse signal TP2. The line start control logic 240 may provide the second timing pulse signal TP2 to the buffer 230.

The buffer 230 may output data voltages Y1 to Ym to the display panel 1200 on the basis of the second timing pulse signal TP2.

Referring again to FIG. 7, in an example embodiment, the line start control logic 240 may receive information DI about the delay time from the timing controller 100. The information DI about the delay time may include an index corresponding to a specific delay time.

In an example embodiment, by using a delay time table DTT (see FIG. 9) including matching information about a plurality of indexes and a plurality of delay times, the line start control logic 240 may check the delay time ($t_{TP_DELAY1}$ of FIG. 8) corresponding to an index included in the information DI about the delay time, and may delay a pulse by the checked delay time to generate the second timing pulse signal TP2.

In another example embodiment, the line start control logic 240 may not receive the information DI about the delay time from the timing controller 100, and may instead generate the second timing pulse signal TP2 from a delay time value stored in the line start control logic 240 or an external memory.

Referring to FIG. 9, the delay time table DTT may include matching information about an index and a delay time. The index may consist of 3 bits, and a value of a corresponding delay time may vary based on whether a level of each bit constituting an index is logic high (H) or logic low (L). The delay time table DTT may include a delay time of about 0.0 μs to about 2.8 μs on the basis of a value of the index, but this is merely an example and embodiments are not limited thereto.

In an example embodiment, the timing controller 100 may determine a certain index on the basis of at least one of a scan unit (for example, two horizontal line units or four horizontal line units) based on a line inversion scheme, information about image data I_DATA, and various information about the display apparatus 1000. Also, the timing controller 100 may add the determined index to the information DI about a delay time, and may provide the index-added information DI to the line start control logic 240.

Although it is described with respect to FIG. 9 that the index consists of 3 bits, embodiments are not limited thereto. For example, an index may consist of more or fewer bits than 3 bits.

Also, although it is described with respect to FIG. 9 that the source driver 200 includes one delay time table DTT, embodiments are not limited thereto. For example, the source driver 200 may be implemented to include an individual delay time table DTT by frame rates of the display apparatus 1000.

Figure 10:
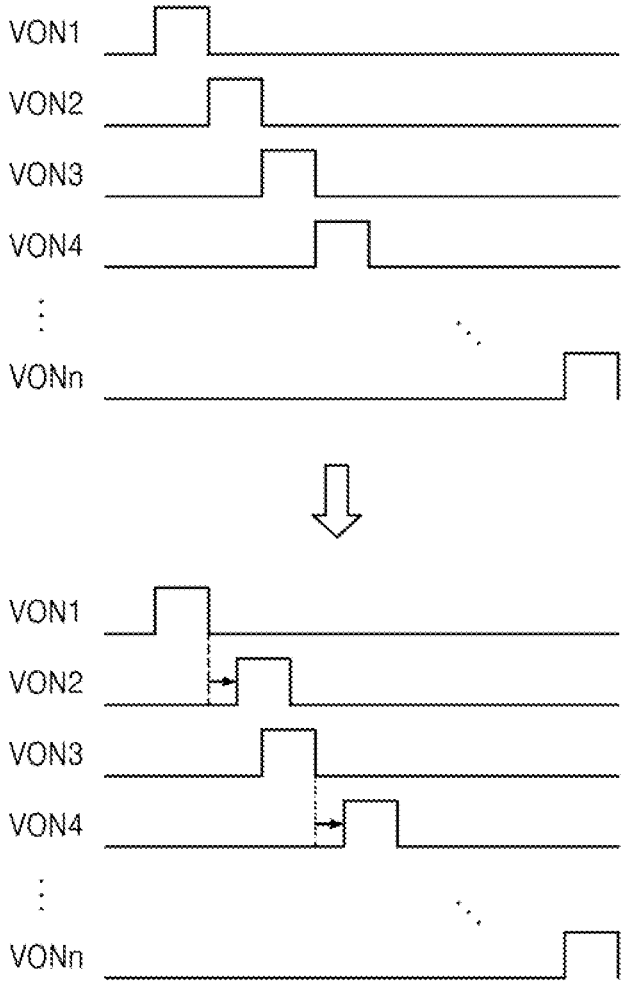
FIG. 10 is a diagram illustrating an operation of a gate driver with a line inversion scheme applied thereto.

FIG. 10 is a diagram illustrating an operation of a gate driver 300 with a line inversion scheme applied thereto. In detail, FIG. 10 shows a plurality of gate-on signals VON1 to VONn respectively corresponding to the plurality of gate lines GL1 to GLn of the display panel 1200.

In the present example embodiment, for convenience of description, an example where the gate driver 300 is based on the 2-line inversion scheme will be described.

Referring to FIG. 10, the gate driver 300 may provide each of the gate-on signals VON1 to VONn to a corresponding gate line of the gate lines GL1 to GLn on the basis of a second control signal CTRL2 received from the timing controller 100. Each of the gate lines GL1 to GLn may be turned on at a time at which a corresponding gate-on signal of the gate-on signals VON1 to VONn is shifted to the active level. Generally, the gate driver 300 may sequentially drive the gate lines GL1 to GLn, and thus, the gate-on signals VON1 to VONn may sequentially have the active level.

According to an example embodiment, the gate driver 300 may drive the gate lines GL1 to GLn on the basis of a data voltage output time of the source driver 200. In detail, the source driver 200 may output a data voltage on the basis of a timing pulse signal, where output timings of some of horizontal lines having the same polarity are delayed in a time allocated to the horizontal lines having the same polarity, and thus, the gate driver 300 may generate the gate-on signals VON1 to VONn on the basis of the timing pulse signal.

Thus, in a case where the source driver 200 outputs a data voltage at a period corresponding to a horizontal line time (i.e., a case that uses a first timing pulse signal TP1), the gate driver 300 may generate the gate-on signals VON1 to VONn, which sequentially have the active level at a certain time interval. However, in a case where the source driver 200 delays an output timing of each of horizontal lines other than a first horizontal line among horizontal lines having the same polarity (i.e., a case that uses a second timing pulse signal TP2), the gate driver 300 may delay a time at which an active level of a gate-on signal of a gate line corresponding to the other horizontal line occurs.

For example, as shown in FIG. 10, when the 2-line inversion scheme is applied, a time at which an active level of the gate-on signal VON2 of the second gate line GL2 (among the first gate line GL1 and the second gate line GL2 having a same polarity (for example, a positive polarity)) occurs may be delayed. Also, a time at which an active level of the gate-on signal VON4 of the fourth gate line GL4 (among the third gate line GL3 and the fourth gate line GL4 having a same polarity (for example, a negative polarity)) occurs may be delayed.

As another example (not shown), when the 4-line inversion scheme is applied, a time at which an active level of each of the gate-on signals VON2 to VON4 of the second to fourth gate lines GL2 to GL4 (among the first to fourth gate lines GL1 to GL4 having a same polarity) occurs may be delayed.

Figure 11:
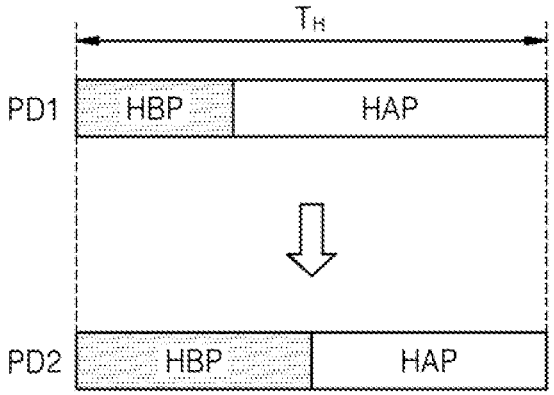
FIG. 11 is a diagram illustrating packet data according to an example embodiment.
Figure 12:
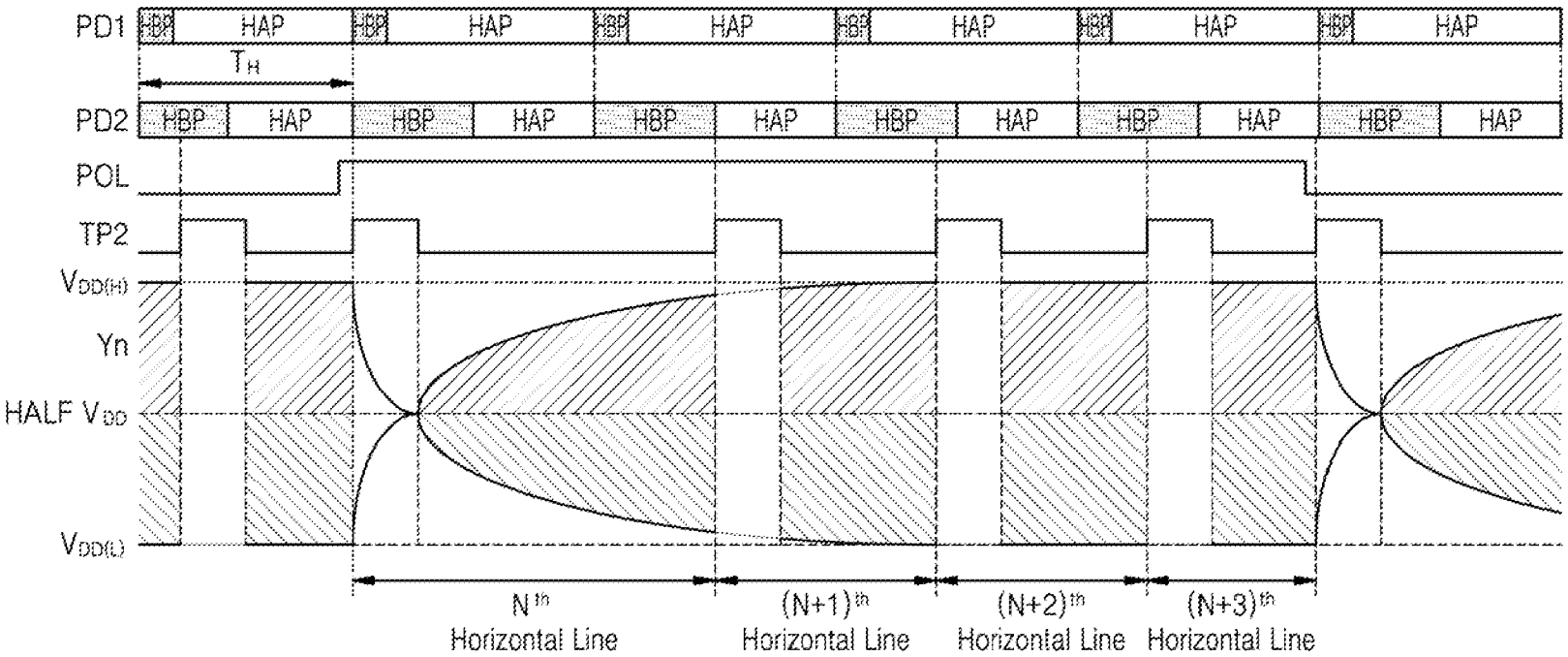
FIG. 12 is a diagram showing waveforms of packet data and various signals, according to an example embodiment.

FIG. 11 is a diagram illustrating packet data according to an example embodiment. FIG. 12 is a diagram showing waveforms of packet data and various signals, according to an example embodiment.

Referring to FIG. 11, pieces of packet data PD1 and PD2 may represent data provided to the source driver 200 by the timing controller 100. The pieces of packet data PD1 and PD2 may include a horizontal blank period HBP and a horizontal active period HAP, and may repeatedly include the periods HBP and HAP per horizontal line time ($T_H$) units.

The horizontal blank period HBP may be a period where the timing controller 100 does not apply pixel data RGB_DATA to the source driver 200, and for example, may be a period that is allocated so that the source driver 200 secures a time for driving the display panel 1200 on the basis of the pixel data RGB_DATA. The horizontal active period HAP may be a period that includes a first control signal CTRL1 and the pixel data RGB_DATA. However, embodiments are not limited thereto, and the pieces of packet data PD1 and PD2 may include an additional period (for example, a line start time representing line start).

The source driver 200 may drive the display panel 1200 in the horizontal active period HAP, and thus the end of a data charging time of each horizontal line (or a rising edge of a pulse of a next horizontal line) may be included in the horizontal blank period HBP. The source driver 200 according to an example embodiment may use a timing pulse signal in which output timings of some horizontal lines (other than a first horizontal line after a polarity is changed) of horizontal lines having the same polarity are delayed. Thus, the end of a data charging time of a certain horizontal line (or a rising edge of a pulse of a next horizontal line) may not occur in the horizontal blank period HBP. Thus, when the horizontal blank period HBP is relatively short (like the packet data PD1 of FIG. 11), the end of a data charging time of each horizontal line (or a rising edge of a pulse of a next horizontal line) may not be included in the horizontal blank period HBP.

Referring to FIG. 12, it can be seen that the end of a data charging time of an $N^{th}$ horizontal line (or a rising edge of a pulse of an N+1$^{th}$ horizontal line) is included in a horizontal active period HAP of the packet data PD1. Therefore, driving of the display panel 1200 may not be actively performed by the source driver 200.

Therefore, as can be seen in the packet data PD2 of FIG. 11, a ratio of the horizontal blank period HBP may be adjusted to increase in a horizontal line time $T_H$. In detail, the packet data PD2 may decrease the horizontal active period HAP and may increase the horizontal blank period HBP, without changing the overall horizontal line time $T_H$. In this case, because data transmission has to be completed in the horizontal active period HAP, an operating frequency of an interface between the timing controller 100 and the source driver 200 may increase. Referring to FIG. 12, it can be seen that the end of a data charging time of an N$^{th}$ horizontal line (or a rising edge of a pulse of an N+1$^{th}$ horizontal line) is included in a horizontal blank period HBP of the packet data PD2. Therefore, driving of the display panel 1200 may be actively performed by the source driver 200.

Figure 13:
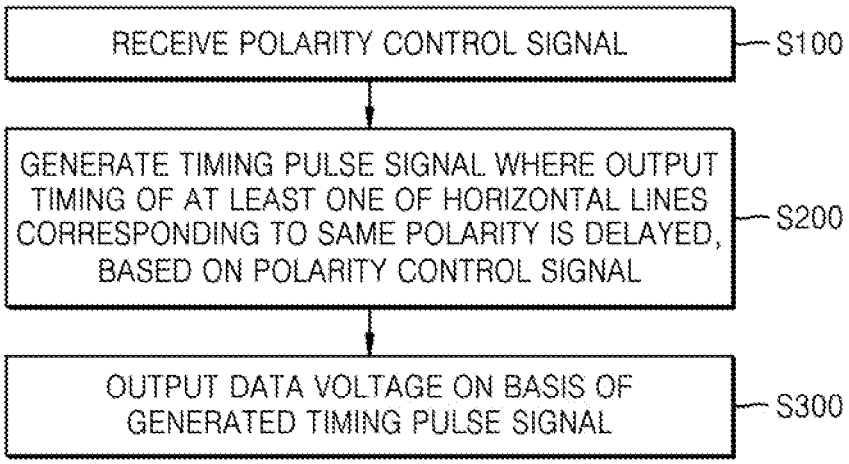
FIG. 13 is a flowchart illustrating an operating method of a source driver, according to an example embodiment.

FIG. 13 is a flowchart illustrating an operating method of a source driver 200, according to an example embodiment. The operating method of FIG. 13 may be performed by the source driver 200 of FIGS. 1, 2, and 7.

Referring to FIG. 13, the source driver 200 may receive a polarity control signal in operation S100. In detail, the source driver 200 may operate based on a line inversion scheme of changing a polarity on the basis of at least one horizontal line unit, and may receive the polarity control signal from the timing controller 100. The polarity control signal may be a signal having a value that is inverted per n horizontal line units.

When a value of the polarity control signal is inverted, the source driver 200 may generate a timing pulse signal including a data charging time corresponding to a count value obtained by counting the number of horizontal lines after inversion is performed, in operation S200. In detail, the source driver 200 may increase the count value whenever a horizontal line time elapses after a value of the polarity control signal is inverted. The source driver 200 may generate the timing pulse signal including a data charging time corresponding to a count value for each of n number of horizontal lines.

In an example embodiment, the source driver 200 may check a data charging time corresponding to a count value of a current horizontal line among a plurality of data charging times, and may determine the checked data charging time as a data charging time of the current horizontal line. In this case, a data charging time corresponding to a smallest count value among the plurality of data charging times may be longest. For example, after a value of the polarity control signal is inverted, a count value of a first horizontal line may be 0 and a count value of a second horizontal line may be 1. In this case, a data charging time corresponding to the first horizontal line may be longer than a data charging time corresponding to a second horizontal line. Also, a longest data charging time may be a time for which a data voltage is charged from a middle level (between a positive data voltage $V_{DD(H)}$ and a negative data voltage $V_{DD(L)}$) to a level of the positive data voltage $V_{DD(H)}$ and a level of the negative data voltage $V_{DD(L)}$.

In operation S300, the source driver 200 may output a data voltage on the basis of the generated timing pulse signal. In detail, the source driver 200 may alternately provide the display panel 1200 with k (where k is an integer of 1 or more) number of positive data voltages and k number of negative data voltages on the basis of the timing pulse signal. In an example embodiment, the source driver 200 may output a data voltage in response to a falling edge of each of pulses included in a timing pulse, and may stop the output of the data voltage in response to a rising edge of each of the pulses of the timing pulse.

Figure 14:
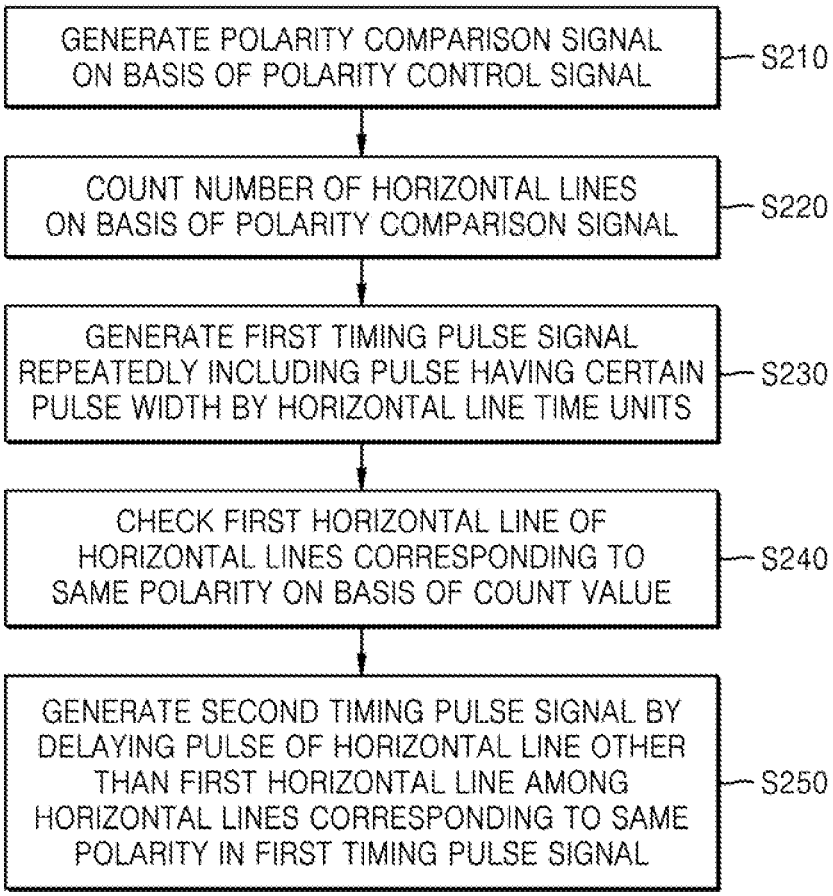
FIG. 14 is a flowchart illustrating a method of generating a timing pulse signal, according to an example embodiment.

FIG. 14 is a flowchart illustrating a method of generating a timing pulse signal, according to an example embodiment. In detail, FIG. 14 is a flowchart illustrating a detailed method of the operation S200 of FIG. 13.

Referring to FIG. 14, in operation S210, the source driver 200 may generate a polarity comparison signal on the basis of a polarity control signal. In detail, the source driver 200 may compare a polarity of a current horizontal line with a polarity of a previous horizontal line to generate the polarity comparison signal. In an example embodiment, when a polarity of the previous horizontal line differs from that of the current horizontal line, the polarity comparison signal may be generated to have a first level (for example, a logic high level), and when a polarity of the previous horizontal line is the same as that of the current horizontal line, the polarity comparison signal may be generated to have a second level (for example, a logic low level). The source driver 200 may generate a reset signal on the basis of the polarity comparison signal. The reset signal may have the active level in association with a polarity-changed horizontal line.

In operation S220, the source driver 200 may count the number of horizontal lines on the basis of the polarity comparison signal. In detail, when a rising edge and a falling edge of the polarity comparison signal are sensed, the source driver 200 may increase a count value of a count signal. When the reset signal has the active level, the count value of the count signal may be reset.

In operation S230, the source driver 200 may generate a first timing pulse signal including pulses having a certain pulse width by horizontal line time units.

In operation S240, the source driver 200 may check a first horizontal line of horizontal lines corresponding to a same polarity on the basis of the count value. In detail, the source driver 200 may check a period corresponding to n number of continuous horizontal lines having a data voltage having the same polarity in the first timing pulse signal.

In operation S250, the source driver 200 may delay a pulse of at least one of horizontal lines corresponding to the same polarity in the first timing pulse signal on the basis of the count value, to generate a second timing pulse signal, and the source driver 200 may output a data voltage from the second timing pulse signal. In detail, the source driver 200 may delay a rising edge time of a pulse of at least one of n number of horizontal lines in the checked period to generate the second timing pulse signal. In an example embodiment, the source driver 200 may delay a rising edge time of a pulse of each of horizontal lines other than a first horizontal line among the n horizontal lines to generate the second timing pulse signal. A period (i.e., a pulse having the active level) of the second timing pulse signal may correspond to a charge sharing operation or a high impedance operation, and another period (i.e., other than the active level) of the second timing pulse signal may correspond to an output operation (i.e., a data charging time) of a data voltage. Therefore, a data charging time of a first horizontal line may be increased.

A time for delaying a pulse of a horizontal line (i.e., a delay time) may be determined based on a time for which a data voltage is charged from a charge sharing voltage to a positive data voltage (or a negative data voltage). When a line inversion scheme based on a unit corresponding to three or more horizontal lines is applied, a delay time of each of the other horizontal lines may be individually set. Information about a delay time may be received from the timing controller 100, or may be stored in the source driver 200 or an external memory.

Figure 15:
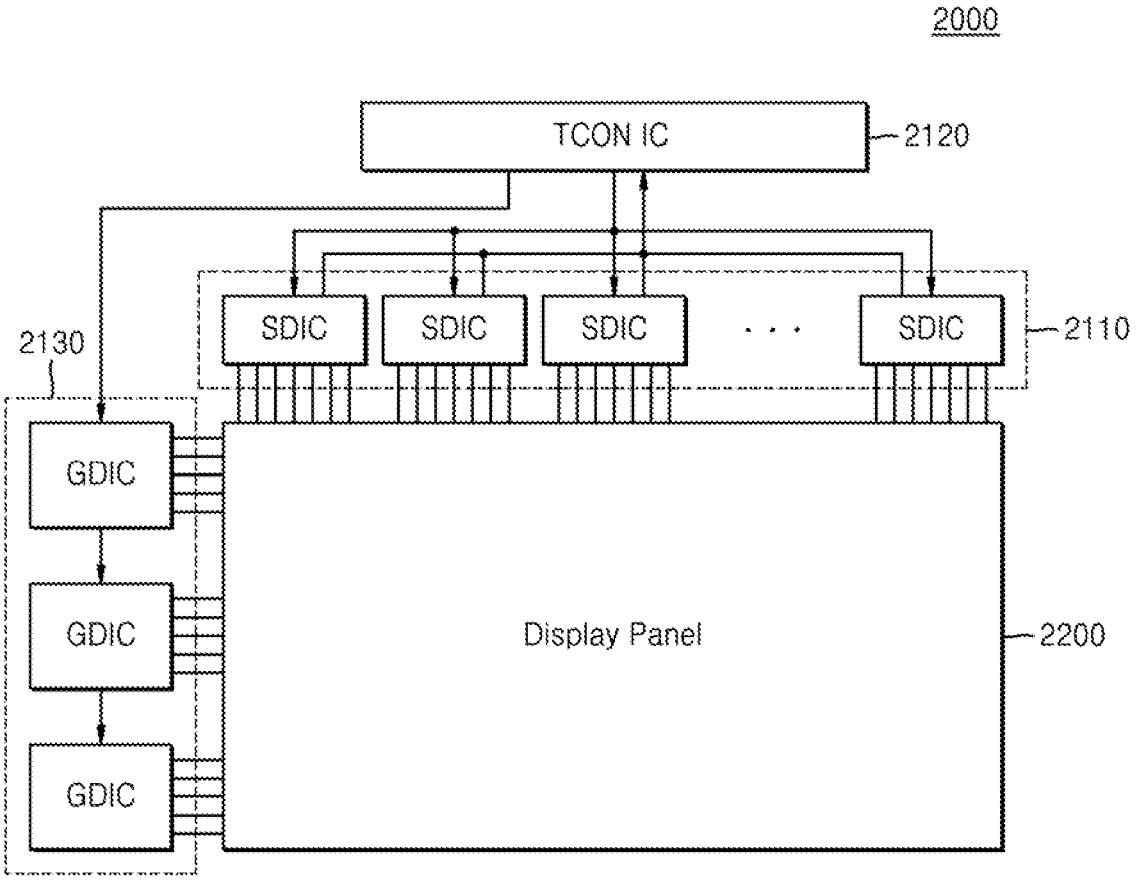
FIG. 15 illustrates an example of a display apparatus according to an example embodiment.

FIG. 15 illustrates an example of a display apparatus 2000 according to an example embodiment. The display apparatus 2000 of FIG. 15 may include an apparatus including a display panel 2200 of a medium or large size, and for example, may be applied to televisions (TVs), monitors, etc.

Referring to FIG. 15, the display apparatus 2000 may include a source driver 2110, a timing controller 2120, a gate driver 2130, and the display panel 2200.

The timing controller 2120 may be configured with one or more source driver integrated circuits (SDICs) or modules. The timing controller 2120 may communicate with the plurality of source driver ICs SDIC and a plurality of gate driver ICs GDIC.

The timing controller 2120 may be an integrated circuit (TCON IC), may generate control signals for controlling a driving timing of each of the plurality of source driver ICs SDIC and the plurality of gate driver ICs GDIC, and may provide the control signals to the plurality of source driver ICs SDIC and the plurality of gate driver ICs GDIC.

The source driver 2110 may include the plurality of source driver ICs SDICs. The plurality of source driver ICs SDIC may be mounted on a circuit film such as a tape carrier package (TCP), a chip on film (COF), or a flexible printed circuit (FPC), and may be attached on the display panel 2200 by using a tape automatic bonding (TAB) type or may be mounted in a non-display area of the display panel 2200 by using a chip on glass (COG) type.

The gate driver 2130 may include the plurality of gate driver ICs GDICs. The plurality of gate driver ICs GDIC may be mounted on a circuit film, and may be attached on the display panel 2200 by using the TAB type or may be mounted in the non-display area of the display panel 2200 by using the COG type. Alternatively, the gate driver 2130 may be directly formed on a lower substrate of the display panel 2200 by using a gate-driver in panel (GIP) type. The gate driver 2130 may be formed in a non-display area outside a pixel array where pixels are formed in the display panel 2200, and may be formed through the same thin film transistor (TFT) process as the pixels.

As described above with reference to FIGS. 1 to 14, the source driver 2110 may generate a timing pulse signal in which a data charging time of each horizontal line of the display panel 2200 is sufficiently secured, based on the polarity control signal, and may output a data voltage to the display panel 2200. Therefore, the display panel 2200 may prevent the occurrence of a fine horizontal line resulting from different data voltage charging ratios of horizontal lines, thereby enhancing image quality.

Figure 16:
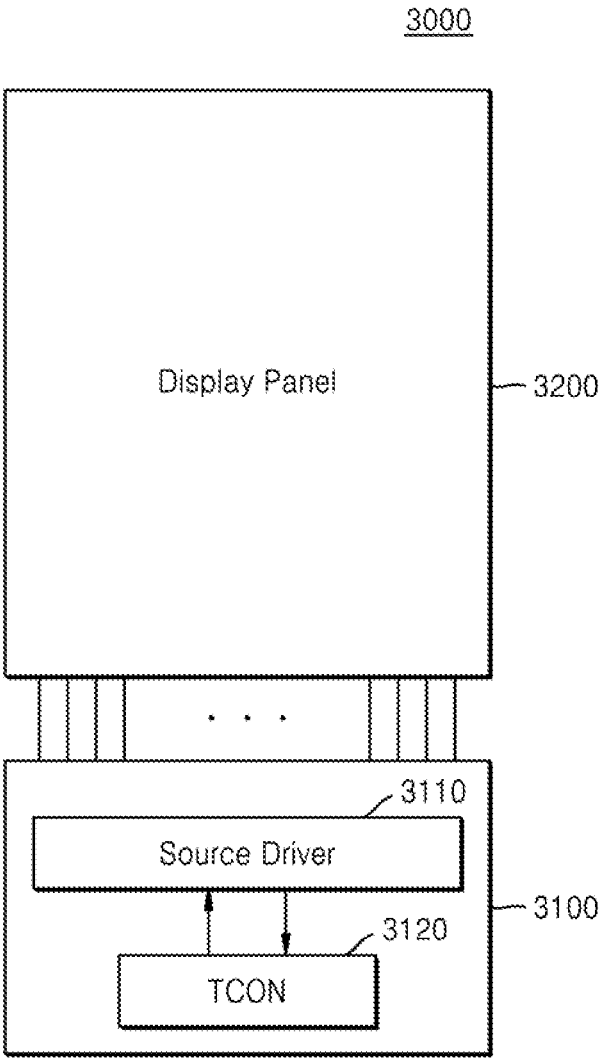
FIG. 16 illustrates an example of a display apparatus according to an example embodiment.

FIG. 16 illustrates an example of a display apparatus 3000 according to an example embodiment. The display apparatus 3000 of FIG. 16 may include an apparatus including a small-sized display panel 3200, and for example, may be applied to mobile devices such as smartphones, tablet personal computers (PCs), etc.

Referring to FIG. 16, the display apparatus 3000 may include a display driving circuit 3100 and a display panel 3200. The display driving circuit 3100 may be configured with one or more ICs, and may be mounted on a circuit film such as the TCP, the COF, or the FPC. Also, the display driving circuit 3100 may be attached on the display panel 3200 by using the TAB type, or may be mounted on the non-display area (for example, an area which does not display an image) by using the COG type.

The display driving circuit 3100 may include a source driver 3110 and a timing controller 3120, and may further include a gate driver (not shown). In an example embodiment, the gate driver may be mounted on the display panel 3200.

As described above with reference to FIGS. 1 to 14, the source driver 3110 may generate a timing pulse signal in which a data charging time of each horizontal line of the display panel 3200 is sufficiently secured, based on the polarity control signal, and may output a data voltage to the display panel 3200. Therefore, the display panel 3200 may prevent the occurrence of a fine horizontal line resulting from different data voltage charging ratios of horizontal lines, thereby enhancing image quality.

By way of summation and review, in order to prevent pixels from being degraded, technology for driving data lines by using a polarity inversion scheme may be implemented. The polarity inversion scheme may include a frame inversion scheme of inverting a polarity by frame units, a line inversion scheme of inverting a polarity by line units, and a dot inversion scheme of inverting a polarity by pixel units.

As described above, embodiments may provide a source driver that determines an output timing of a data voltage corresponding to each of a plurality of horizontal lines of a display panel on the basis of a polarity control signal, a display apparatus including the source driver, and an operating method of the source driver.

Embodiments may provide a source driver that generates a timing pulse signal representing a data charging time corresponding to each of a plurality of horizontal lines of a display panel on the basis of a polarity control signal, a display apparatus including the source driver, and an operating method of the source driver.

Example embodiments have been disclosed herein, and although specific terms are employed, they are used and are to be interpreted in a generic and descriptive sense only and not for purpose of limitation. In some instances, as would be apparent to one of ordinary skill in the art as of the filing of the present application, features, characteristics, and/or elements described in connection with a particular embodiment may be used singly or in combination with features, characteristics, and/or elements described in connection with other embodiments unless otherwise specifically indicated. Accordingly, it will be understood by those of skill in the art that various changes in form and details may be made without departing from the spirit and scope of the present invention as set forth in the following claims.

What is claimed is:

1. A display apparatus, comprising:

a display panel including a plurality of horizontal lines each including a plurality of pixels;

a source driver configured to generate a timing pulse signal sequentially representing a data charging time of each of the plurality of horizontal lines, and configured to output a data voltage, having a polarity corresponding to each of the plurality of horizontal lines, to the display panel based on the timing pulse signal; and a timing controller configured to output a polarity control signal representing the polarity of the data voltage corresponding to each of the plurality of horizontal lines, the polarity control signal having a value that is inverted according to n (where n is a positive integer) horizontal line units, wherein, when the value of the polarity control signal is inverted, the source driver generates the timing pulse signal representing the data charging time corresponding to a count value obtained by counting a number of horizontal lines after the polarity of the data voltage is inverted, wherein:

the data charging time includes a plurality of data charging times, a longest data charging time of the plurality of data charging times corresponds to a smallest count value, and the longest data charging time includes a time for which a data voltage is charged from a middle voltage level, which is between a level of a positive data voltage and a level of a negative data voltage, to the level of the positive data voltage or the level of the negative data voltage.

2. The display apparatus as claimed in claim 1, wherein the timing pulse signal includes data charging times of n horizontal lines corresponding to the same polarity for a time corresponding to the n horizontal lines.

3. The display apparatus as claimed in claim 1, wherein the source driver is configured to:

generate a reference timing pulse signal repeatedly including a certain data charging time at a period corresponding to one horizontal line time, and generate the timing pulse signal by changing n number of data charging times in the reference timing pulse signal by n horizontal line units corresponding to the same polarity identified by the polarity control signal.

4. The display apparatus as claimed in claim 3, wherein the source driver is configured to generate the timing pulse signal by delaying a start point of a data charging time of at least one of the n horizontal lines in the reference timing pulse signal based on a delay time corresponding to the count value.

5. The display apparatus as claimed in claim 4, wherein the source driver is configured to generate the timing pulse signal by delaying a start point of a data charging time of each of horizontal lines other than a first horizontal line among the n horizontal lines in the reference timing pulse signal.

6. The display apparatus as claimed in claim 4, wherein the source driver is configured to:

generate a polarity comparison signal, which represents a first level when a polarity of a previous horizontal line is the same as a polarity of a current horizontal line, and which represents a second level when the polarity of the previous horizontal line differs from the polarity of the current horizontal line, based on the polarity control signal, and count a rising edge and a falling edge of the polarity comparison signal to generate a count signal representing a count value of a corresponding horizontal line.

7. The display apparatus as claimed in claim 6, wherein the source driver is configured to generate the timing pulse signal by delaying a start point of a data charging time of at least one of the n horizontal lines in the reference timing pulse signal based on a delay time corresponding to the count value of the count signal.

8. A driving method of a source driver, the driving method comprising:

receiving a polarity control signal representing a polarity corresponding to each of a plurality of horizontal lines of a display panel, the polarity control signal having a value inverted by n (where n is a positive integer) horizontal line units;

generating a first timing pulse signal including pulses having a certain pulse width at a period corresponding to one horizontal line time;

generating a second timing pulse signal by varying a rising edge time relative to each of the pulses in the first timing pulse signal, based on the polarity control signal; and outputting a data voltage, having a polarity corresponding to each of the plurality of horizontal lines based on the second timing pulse signal, to the display panel, wherein the outputting of the data voltage includes:

outputting the data voltage in response to a falling edge of each of pulses included in the second timing pulse signal; and stopping the outputting of the data voltage in response to a rising edge of each of the pulses included in the second timing pulse signal.

9. The driving method as claimed in claim 8, wherein the generating of the second timing pulse signal includes:

checking a period corresponding to n number of continuous horizontal lines having a data voltage having the same polarity in the first timing pulse signal; and generating the second timing pulse signal by delaying a rising edge time of a pulse of at least one of the n horizontal lines in the checked period.

10. The driving method as claimed in claim 9, wherein the generating of the second timing pulse signal by the delaying of the rising edge time of the pulse of at least one of the n horizontal lines in the checked period includes generating the second timing pulse signal by delaying a rising edge time of a pulse of each of horizontal lines other than a first horizontal line among the n horizontal lines.

11. The driving method as claimed in claim 9, wherein the generating of the second timing pulse signal by the delaying of the rising edge time of the pulse of at least one of the n horizontal lines in the checked period includes delaying the rising edge time of the pulse by a delay time corresponding to a count value obtained by counting a number of horizontal lines in the checked period.

12. The driving method as claimed in claim 11, wherein the delay time corresponding to the count value increases as the count value increases.

13. The driving method as claimed in claim 11, wherein the generating of the second timing pulse signal by the delaying of the rising edge time of the pulse of at least one of the n horizontal lines in the checked period includes:

generating a polarity comparison signal, representing a first level when a polarity of a previous horizontal line is the same as a polarity of a current horizontal line and representing a second level when the polarity of the previous horizontal line differs from the polarity of the current horizontal line, based on the polarity control signal; and generating a count signal representing a count value of a corresponding horizontal line by counting a rising edge and a falling edge of the polarity comparison signal.

14. A source driver, comprising:

a control logic configured to receive a polarity control signal representing a polarity corresponding to each of a plurality of horizontal lines of a display panel and having a value inverted by n (where n is a positive integer) horizontal line units, and configured to generate a timing pulse signal sequentially representing a data charging time of each of the plurality of horizontal lines; and a buffer configured to output a data voltage to the display panel based on the timing pulse signal, wherein:

the control logic is configured to, when a value of the polarity control signal is inverted, generate the timing pulse signal including a data charging time corresponding to a count value obtained by counting a number of horizontal lines after a polarity is inverted, wherein:

the control logic is configured to generate a reference timing pulse signal repeatedly including a certain data charging time at a period corresponding to one horizontal line time, and the control logic is configured to generate the timing pulse signal by delaying a start point of a data charging time of at least one of n number of horizontal lines in the reference timing pulse signal based on a delay time corresponding to the count value.

15. The source driver as claimed in claim 14, wherein the control logic is configured to generate the timing pulse signal so that a data charging time of a first horizontal line of n number of horizontal lines after a polarity is inverted is a longest data charging time.

16. The source driver as claimed in claim 15, wherein the data charging time of the first horizontal line includes a time for which a data voltage is charged from a middle voltage level, between a level of a positive data voltage and a level of a negative data voltage, to the level of the positive data voltage or the level of the negative data voltage.

17. A display driving circuit for driving a display panel including a plurality of horizontal lines each including a plurality of pixels, comprising:

a source driver configured to generate a timing pulse signal sequentially representing a data charging time of each of the plurality of horizontal lines, and configured to output a data voltage, having a polarity corresponding to each of the plurality of horizontal lines, to the display panel based on the timing pulse signal; and a timing controller configured to output a polarity control signal representing the polarity of the data voltage corresponding to each of the plurality of horizontal lines, the polarity control signal having a value that is inverted according to n (where n is a positive integer) horizontal line units, wherein, when the value of the polarity control signal is inverted, the source driver generates the timing pulse signal so that a data charging time of a first horizontal line of n number of horizontal lines after a polarity is inverted is a longest data charging time, wherein:

the longest data charging time includes a time for which a data voltage is charged from a middle voltage level, which is between a level of a positive data voltage and a level of a negative data voltage, to the level of the positive data voltage or the level of the negative data voltage.

18. The display driving circuit as claimed in claim 17, wherein the source driver is configured to:

generate a reference timing pulse signal repeatedly including a certain data charging time at a period corresponding to one horizontal line time, and generate the timing pulse signal by changing n number of data charging times in the reference timing pulse signal by n horizontal line units corresponding to the same polarity identified by the polarity control signal.

19. The display driving circuit as claimed in claim 18, wherein the source driver is configured to:

generate the timing pulse signal by delaying a start point of a data charging time of each of horizontal lines other than a first horizontal line among the n horizontal lines in the reference timing pulse signal.

20. The display driving circuit as claimed in claim 18, wherein the source driver is configured to:

generate a polarity comparison signal, which represents a first level when a polarity of a previous horizontal line is the same as a polarity of a current horizontal line, and which represents a second level when the polarity of the previous horizontal line differs from the polarity of the current horizontal line, based on the polarity control signal, and count a rising edge and a falling edge of the polarity comparison signal to generate a count signal representing a count value of a corresponding horizontal line.

* * * * *